US011322883B1

(12) United States Patent
Potterf et al.

(10) Patent No.: US 11,322,883 B1
(45) Date of Patent: May 3, 2022

(54) HIGH VOLTAGE DIRECT CURRENT CONNECTOR ASSEMBLY OR ADAPTER WITH ARC PROTECTION

(71) Applicant: CISCO TECHNOLOGY, INC., San Jose, CA (US)

(72) Inventors: Jason DeWayne Potterf, Austin, TX (US); Edward John Kliewer, Sunnyvale, CA (US); Larkin Hale Andreaus, Raleigh, NC (US); Yaodong Shen, Ann Arbor, MI (US); Kevin Mechler, Bastrop, TX (US); Tatenda Maxwell Mbwetu, Greensboro, NC (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 17/113,758

(22) Filed: Dec. 7, 2020

(51) Int. Cl.

| | |
|---|---|
| ***H01R 13/53*** | (2006.01) |
| ***H01R 13/703*** | (2006.01) |
| ***H01R 31/06*** | (2006.01) |
| ***H01R 13/648*** | (2006.01) |
| ***H01R 43/26*** | (2006.01) |

(52) U.S. Cl.
CPC ..... *H01R 13/53* (2013.01); *H01R 13/648* (2013.01); *H01R 13/7036* (2013.01); *H01R 31/06* (2013.01); *H01R 43/26* (2013.01)

(58) Field of Classification Search
CPC .... H01R 2103/00; H01R 13/703–7032; H01R 13/53; H01R 13/7036; H01R 13/648; H01R 13/447; H01R 13/4534; H01R 31/06; H01R 43/26; H01H 1/38; H01H 1/385; H01H 2203/022
USPC ..... 439/188, 638, 136, 137, 147, 145
See application file for complete search history.

(56) References Cited

U.S. PATENT DOCUMENTS

| | | | | |
|---|---|---|---|---|
| 3,982,804 A * | 9/1976 | Marechal | H01R 13/645 | 439/139 |
| 5,286,213 A * | 2/1994 | Altergott | H01R 13/4532 | 200/51.09 |
| 5,484,299 A * | 1/1996 | Schlessinger | H01R 13/4532 | 200/51.1 |
| 5,795,168 A * | 8/1998 | Duhe | H01R 13/652 | 200/51.09 |

(Continued)

FOREIGN PATENT DOCUMENTS

CN 110190438 A 8/2019

OTHER PUBLICATIONS

Sager Electronics, Anderson Power Products' Saf-D-Grid® 400, Aug. 28, 2020.

*Primary Examiner* — Gary F Paumen

(57) ABSTRACT

In one embodiment, an electrical receptacle includes a housing, stationary electrical contacts for transferring power received at the electrical receptacle to a connected device, pin contacts for mating with socket contacts on a plug to create a first connection when the plug is moved along a longitudinal axis of the housing, and internal contacts extending from the pin contacts and located within the housing for mating with the stationary electrical contacts to create a second connection with movement of the plug different from movement for the first connection. An electrical arc created between one of the internal contacts and one of the stationary electrical contacts is contained within the housing. A method and adapter are also disclosed herein.

25 Claims, 14 Drawing Sheets

(56) References Cited

U.S. PATENT DOCUMENTS

| | | | | |
|---|---|---|---|---|
| 5,967,815 | A * | 10/1999 | Schlessinger | H01R 29/00 200/51.09 |
| 6,015,307 | A * | 1/2000 | Chiu | H01R 13/71 200/51.09 |
| 8,044,537 | B2 * | 10/2011 | Asplund | H02M 7/5387 307/82 |
| 9,450,365 | B1 * | 9/2016 | Baldwin | H01R 13/639 |
| 9,859,665 | B2 * | 1/2018 | Rohr | H01R 13/7038 |
| 9,905,969 | B1 * | 2/2018 | Baldwin | H01R 13/639 |
| 11,096,303 | B2 * | 8/2021 | Zhang | H01R 13/71 |
| 2009/0295225 | A1 | 12/2009 | Asplund et al. | |
| 2013/0102194 | A1 * | 4/2013 | Long | H01R 25/003 439/620.21 |
| 2016/0079718 | A1 | 3/2016 | Rohr et al. | |
| 2018/0212369 | A1 * | 7/2018 | Bulmer | H01R 13/533 |
| 2019/0313546 | A1 | 10/2019 | Zhang et al. | |

* cited by examiner

HIGH VOLTAGE DIRECT CURRENT CONNECTOR ASSEMBLY OR ADAPTER WITH ARC PROTECTION

TECHNICAL FIELD

The present disclosure relates generally to electrical connectors, and more particularly, to a high voltage direct current (HVDC) connector or adapter for an HVDC connector.

BACKGROUND

The use of HVDC in telecommunications equipment is rapidly developing along with next generation DC systems. By shifting to systems that can use HVDC, users are encouraged to implement renewable energy sources to power buildings and worksites. HVDC provides many benefits, including higher efficiency and lower operating expenses, but also introduces implementation hurdles to overcome. While the cost of making a standard power supply HVDC compliant may be minimal in some cases, a larger problem that needs to be overcome is related to HVDC connections, which are fundamentally hazardous and typically require specialized proprietary connectors to mitigate these hazards.

BRIEF DESCRIPTION OF THE FIGURES

Corresponding reference characters indicate corresponding parts throughout the several views of the drawings.

DESCRIPTION OF EXAMPLE EMBODIMENTS

Overview

Figure 1A:
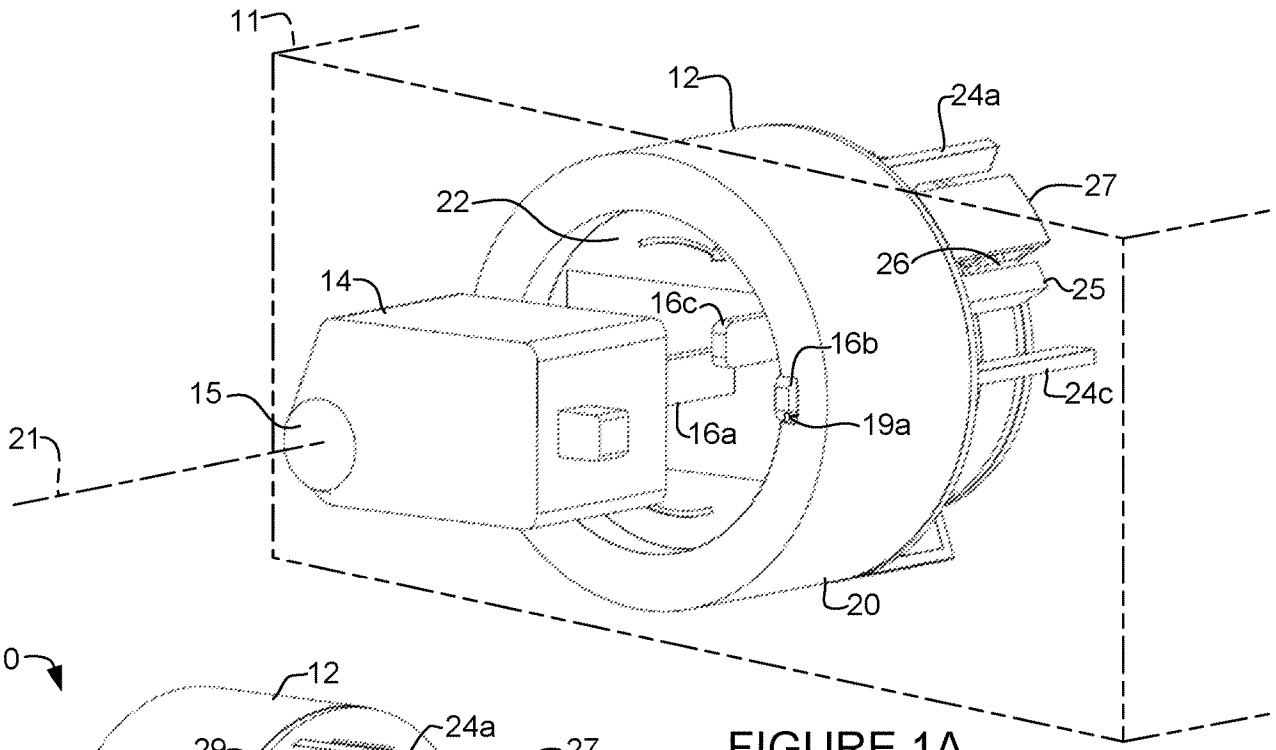
FIG. 1A is a front perspective of a high voltage direct current (HVDC) connector assembly with a plug and receptacle aligned for connection, in accordance with one embodiment.

In one embodiment, an electrical receptacle generally comprises a housing, stationary electrical contacts for transferring power received at the electrical receptacle to a connected device, pin contacts for mating with socket contacts on a plug to create a first connection when the plug is moved along a longitudinal axis of the housing, and internal contacts extending from the pin contacts and located within the housing for mating with the stationary electrical contacts to create a second connection with movement of the plug different from movement for the first connection. An electrical arc created between one of the internal contacts and one of the stationary electrical contacts is contained within the housing.

In another embodiment, a method generally comprises engaging pin contacts on a receptable with socket contacts on a plug with a first movement of the plug along a longitudinal axis of the receptacle, and engaging internal contacts extending from the pin contacts with stationary electrical contacts in the receptacle with a second movement of the plug different from the first movement. An electrical arc created between one of the internal contacts and one of the stationary electrical contacts is contained within a housing of the receptacle.

In yet another embodiment, an adapter comprises a body, a plug connected to the body and configured for mating with a receptacle on a device to create a connection without electrical arc protection, an HVDC (High Voltage Direct Current) receptacle connected to the body and configured with electrical arc protection, the HVDC receptacle electrically coupled to the plug, and a housing comprising an opening corresponding to the HVDC receptacle. The housing is slidable relative to the body as the adapter moves from a first position to a second position when the housing is attached to the device. The HVDC receptacle is at least partially blocked by the housing to prevent connection with an HVDC plug when the adapter is in the first position, and the opening in the housing is aligned with the HVDC receptacle when the adapter is in the second position to allow connection with the HVDC plug and prevent removal of the adapter from the device with the HVDC plug connected to the HVDC receptacle.

Further understanding of the features and advantages of the embodiments described herein may be realized by reference to the remaining portions of the specification and the attached drawings.

Example Embodiments

The following description is presented to enable one of ordinary skill in the art to make and use the embodiments. Descriptions of specific embodiments and applications are provided only as examples, and various modifications will be readily apparent to those skilled in the art. The general principles described herein may be applied to other applications without departing from the scope of the embodiments. Thus, the embodiments are not to be limited to those shown, but are to be accorded the widest scope consistent with the principles and features described herein. For purpose of clarity, details relating to technical material that is known in the technical fields related to the embodiments have not been described in detail.

High voltage direct current (HVDC) provides many benefits but there are still a number of drawbacks with regards to available connectors. IEC (International Electrotechnical Commission) 60320 is a set of standards specifying power connectors, which include connector types such as C13/C14 or C19/C20, which are commonly used with telecommunications equipment. However, standard IEC 60320 connectors cannot be used with HVDC since they are limited to 250 VAC (volts alternating current). Currently available HVDC connectors are single sourced, expensive, and have a limited life span since they utilize a sacrificial contact with a very low plug cycle count.

Challenges with HVDC connectors include increased creepage and clearance requirements, increased difficulty with DC current interruption, and arc flash risks on connect and disconnect. While the mating surfaces of IEC connectors may meet creepage and clearance requirements, HVDC current interruption is much more difficult than AC current interruption due to the lack of zero-crossing. Unlike AC power, in which the sinusoidal nature of the alternating current causes the voltage to be zero at some point during the electrical contact separation and any arcing will tend to self-extinguish, disconnecting connectors under load is much more of a concern in HVDC applications since the voltage is constant and electrical arcing between the separating contacts is maintained over a substantial range of contact separation. Connecting or disconnecting under load may lead to electrical arcing between contacts of a live electrical connector and presents a safety hazard to a user, and may reduce the useful life of the connector, thereby reducing component life span and reliability, and increasing operating expenses and safety concerns.

The embodiments described herein provide two approaches to HVDC connections. In a first embodiment, a connector assembly provides a backwards compatible receptable with electrical arc containment. The embodiment includes one or more safety alterations to conventional standard connectors to allow for HVDC use without preventing legacy AC use. As described in detail below, a plug retention feature and interlock mechanism that controls a power supply's operational status may be provided along with arc containment within a receptacle housing, which changes the act of connecting a power cord to a receptacle from being an exposed (external) arc flash hazard to an enclosed (internal) safe process.

In a second embodiment, an adapter is provided to mitigate HVDC connection/disconnection hazards while adapting to a standard connector permanently installed on a power supply or other device. As described in detail below, the embodiment utilizes a mechanical interlock, which may be reinforced with an optional electrical interlock, to prevent removal of the adapter when an HVDC cable is installed.

Figure 1B:
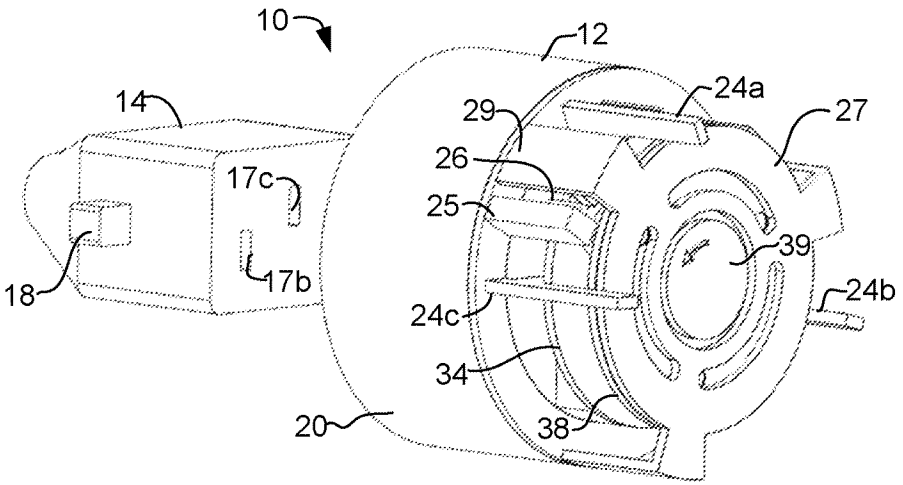
FIG. 1B is a rear perspective of the HVDC connector assembly of FIG. 1A.

Referring now to the drawings, and first to FIGS. 1A and 1B, a connector assembly (coupler), generally indicated at 10, is shown in accordance with a first embodiment. The connector assembly 10 comprises a receptacle 12 (inlet, jack, socket, appliance inlet) and a plug 14 (connector, outlet, plug connector, appliance outlet) connected to (integral with, intended to be attached to) an electrical cable (cord set, jumper cord set, interconnection cord set, power cord) (not shown) at end 15 of the plug for transmitting power from a power source (supply). The receptacle 12 is installed in a device 11 (e.g., switch, router, server, data center equipment, or other network device, power system, power supply (e.g., power supply unit in network device), test equipment, appliance, computing device, power distribution equipment, or another electrical or electronic device or adapter). For simplification, only a portion of the device 11 is shown in FIGS. 1A and 1*t* is to be understood that the device may be any size or shape with the receptacle 12 positioned in any location on the device. The receptacle 12 may be integrated as part of the device 11 or incorporated as a separate part in the equipment or intended to be fixed thereto.

In one embodiment, the electrical receptacle 12 comprises a housing (shell 20, end cap 27), stationary electrical contacts 24*a*, 24*b*, 24*c* for transferring power received at the electrical receptacle to the connected device 11, pin contacts 16*a*, 16*b*, 16*c* for mating with socket contacts 17*a*, 17*b*, 17*c* on the plug 14 to create a first (external, exposed) connection when the plug is moved in a first direction along a longitudinal axis 21 of the housing (e.g., longitudinal movement towards the receptacle), internal contacts 30*a*, 30*b*, 30*c* (shown in FIG. 2) extending the from pin contacts (e.g., extending radially outward therefrom) and located within the housing for mating with the stationary electrical contacts 24*a*, 24*b*, 24*c* to create a second (internal) connection with a second movement (e.g., clockwise rotation about the longitudinal axis 21 as viewed in FIG. 1A) different from the first movement for the first connection. An electrical arc created between one or more of the internal contacts and the stationary electrical contacts (e.g., 30*a* and 24*a*, 30*b* and 24*b*) is contained within the housing.

It is to be understood that the term "longitudinal axis of the housing" or "longitudinal axis of the receptacle" as used herein refers to movement along an axis defining mating contact between the pin contacts 16*a*, 16*b*, 16*c* and the socking contacts 17*a*, 17*b*, 17*c*. The pin contacts 16*a*, 16*b*, 16*c* may extend at any angle or from any face (e.g., front, side) of the receptacle or housing and define the longitudinal axis through which engagement is made.

As shown in FIG. 1A, the receptacle 12 comprises the pin contacts (male portion) (positive (line) contact 16*a*, negative (neutral) contact 16*b*, and ground contact 16*c*) and the plug 14 comprises the socket contacts (female portion) 17*a*, 17*b*, 17*c* for receiving the respective pin contacts 16*a*, 16*b*, 16*c*. The pin contacts 16*a*, 16*b*, 16*c* and mating socket contacts 17*a*, 17*b*, 17*c* are referred to herein as external contacts that create the first (external) connection. In one or more embodiments, the external mating connection (pin contacts, socket contacts) corresponds to a standard connector (e.g., IEC 60320 C13/C14 or C19/C20). In conventional connector assemblies, an electrical arc (arc flash, electrical arcing) may be created as these external contacts mate when a power connection is established. One or more embodiments described herein contain an arc within a receptacle housing (defined by the shell 20 and end cap 27) when the second (internal) connection establishes a power connection. The second connection is formed within the housing to contain an electrical arc created during the connection or disconnection process within the receptacle housing. It is to be understood that the receptacle housing shown in FIGS. 1A and 1B is only an example and the housing may be different than shown and described herein without departing from the scope of the embodiments. For example, the housing may be partially open or may form a closed enclosure.

In the example shown in FIGS. 1A and 1B, the plug 14 is configured for transmitting HVDC and includes a retention (locking) tab 18 (or tabs) for mating with a locking feature (internal recess) on the shell 20 as described below with respect to FIGS. 6A and 6B. As previously noted, the receptacle 12 is backwards compatible for mating with a plug transmitting AC power in accordance with IEC 60320 or other current or future standard, in which case the retention tabs 18 may be excluded from the plug 14. Thus, the electrical receptacle 12 is configured for receiving HVDC or AC from the plug 14 and the receptacle to plug interface may be configured in accordance with any suitable standard to provide backwards compatibility.

The socket contacts 17*a*, 17*b*, 17*c* of the plug 14 are aligned with the pin contacts 16*a*, 16*b*, 16*c* of the receptacle 12 and the tabs 18 on the sides of the plug are aligned with slots 19*a* on an inner wall of the shell 20 to begin the process of connecting the plug and receptacle. The plug 14 is moved along the longitudinal axis 21 of the receptacle to mate the pin contacts 16*a*, 16*b*, 16*c* with the corresponding socket contacts 17*a*, 17*b*, 17*c* and create the first (external, exposed) connection. The longitudinal axis 21 of the receptacle may also correspond to a cable axis in a straight plug and cable arrangement, for example.

The plug 14 is then rotated about the longitudinal axis 21 to create the second (internal) connection between the internal contacts extending from an opposite end of the pin contacts and the stationary electrical contacts 24*a*, 24*b*, 24*c* for transferring power received at the electrical receptacle to the connected device 11. In the example shown in FIGS. 1A and 1B, the plug is rotated clockwise (as viewed looking into the receptacle in FIG. 1A) about the longitudinal axis 21. As noted below, movement (motion) of the plug and coupled body of the receptacle to create the second connection may also comprise a longitudinal, lateral, or rotational movement along or about an axis other than the longitudinal axis 21. For example, a second movement to create the second connection may comprise translation along a lateral axis.

As described in detail below with respect to FIGS. 7A-7D, rotation of the plug 14 coupled to the receptacle 12 causes rotation of a rotor 22 (body) of the receptacle within the stationary shell 20 and creates the second connection. As the internal connectors, which are now electrically coupled to the power supply through the first connection, approach the electrical contacts 24*a*, 24*b*, 24*c*, an electrical arc may occur due to compliance capacitors charging at the device 11 and is contained within the receptacle housing.

In one or more embodiments, the electrical receptacle 12 may also include an integrated power supply enable switch 25 to reduce severity of the arc. In the example shown in FIGS. 1A and 1B, the enable switch 25 is mounted on the shell 20 and includes an actuation device 26 (e.g., button, mechanical switch) activated by a tab coupled to the rotor 22 as the rotor reaches the end of its rotation, as described below with respect to FIG. 7D. The arc may be greatly reduced since the power supply enable signal is negated until the enable switch 25 is activated.

For simplification, an electrical connection between the stationary electrical contacts 24*a*, 24*b*, 24*c* and enable switch 25 of the electrical receptacle 12 with the device 11 are not shown and may be formed by any suitable means, as is well known by those skilled in the art.

In one or more embodiments, the plug 14 may be locked in place once rotation is completed by a locking element on the shell 20 configured to retain the tabs 18, and one or more compression springs (described below with respect to FIGS. 4, 6A, and 6B). The locking element retains the plug 14 in the receptacle after both connections (external and internal) have been made and the enable signal has been activated. The plug 14 may be disconnected from the receptable by applying a force to the plug 14 in a direction towards the receptacle 12 along the longitudinal axis 21 to compress the springs and permit rotation of the plug in the counterclockwise direction (as viewed facing the receptacle shown in FIG. 1A).

It should be noted that the terms rear, rearward, front, forward, lower, upper, bottom, top, below, above, clockwise, counterclockwise, and the like, which may be used herein are relative terms dependent upon the orientation of the connector assembly and should not be interpreted in a limiting manner. These terms describe points of reference and do not limit the embodiments to any particular orientation or configuration. For ease of description, an end of the receptacle 12 (viewable from a front end of the device 11) is referred to as a front of the receptacle (front view in FIG. 1A) and an opposite end defined by the end cap 27 (located within the device) is referred to as a rear of the receptacle (rear view in FIG. 1B).

Figure 2:
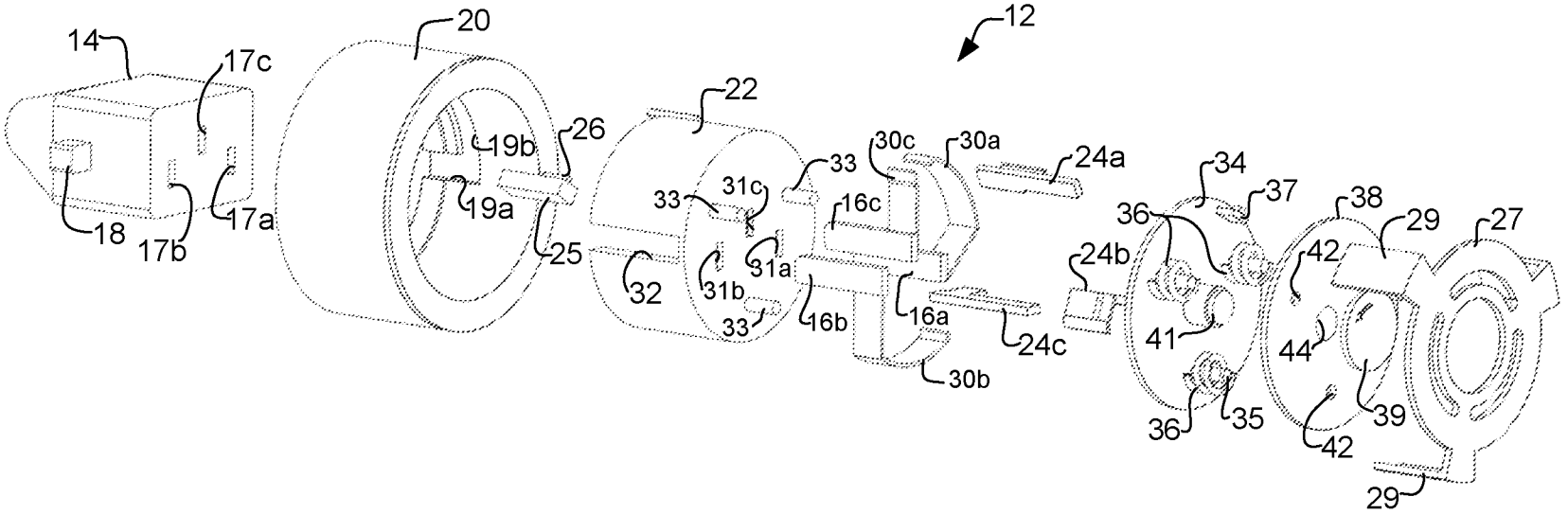
FIG. 2 is an exploded perspective of the HVDC connector assembly shown in FIGS. 1A and 1B.

FIG. 2 is an exploded view of the receptable, generally indicated at 12, and the plug 14. As described above, the plug 14 comprises socket contacts 17*a*, 17*b*, and 17*c*, which may be configured according to a standard such as IEC 60320. Interaction between the retaining tab 18 on the plug 14 and slot 19*a*, internal groove 19*b*, and recess 19*c* (shown in FIG. 6B) on an inner wall of the shell 19 is described below with respect to FIGS. 6A and 6B.

The receptacle 12 generally comprises the stationary shell 20 and end cap 27 (defining the housing), the rotor 22, pin contacts 16*a*, 16*b*, 16*c*, internal contacts 30*a*, 30*b*, 30*c* extending from the respective pin contacts, stationary electrical contacts 24*a*, 24*b*, 24*c*, cover plate 34, and bearing plate 38. The rotor 22 is coupled to the cover plate 34 through insertion of fingers 33 extending outward from a rear face of the rotor into aligned cylindrical posts 35 in the cover plate. The cover plate 34 further includes a center post 41. The posts 35 and 41 extending rearward from the cover plate 34 fit into openings 42, 44 in the bearing plate 38. A cap 39 is placed over the post 41 after it is inserted through opening 44. The rotor 22, cover plate 34, and bearing plate 38 rotate together within the stationary housing. The rotor 22 comprises slots 32 for receiving the locking tabs 18 on the plug 14 and openings 31*a*, 31*b*, 31*c* for receiving the pin contacts 16*a*, 16*b*, and 16*c*. Once the pin contacts 16*a*, lb, 16*c* are inserted into the socket contacts 17*a*, 17*b*, 17*c* on the plug 14 to form the first connection, rotation of the plug 14 causes rotation of the rotor 22 and connected components.

Each of the pin contacts 16*a*, 16*b*, 16*c* is connected (e.g., integral with) the respective internal contact 30*a*, 30*b*, 30*c*. The internal contact 30*c* comprises a contact arm extending generally perpendicular from the ground pin connect 16*c*.

The internal contacts 30*a*, 30*b* extending radially outward from the positive and negative pin contacts each comprise an arc shaped brush portion configured to extend along a portion of the circumference of a circle defined by an outer edge of the rotor 22, when the pin contacts are inserted into the openings 31*a*, 31*b* of the rotor. As described below with respect to FIG. 7C, as the rotor 22 and pin contacts 16*a*, 16*b* rotate, the arc shaped brush portions of the internal contacts 30*a*, 30*b* brush against a brush (wipe) area of the electrical contacts 24*a*, 24*b*.

As shown in FIG. 2, compression springs 36 are placed on the posts 35 of the cover plate 34 and used as part of the locking mechanism to keep the rotor 22 locked in place and prevent removal of the plug 14 after the second connection is made. The springs 36 are compressed when the plug 14 is inserted into the receptacle 12 and a force is applied to the plug 14 along the longitudinal axis 21 towards the receptacle (FIGS. 1A and 2). When the plug 14 and rotor 20 are rotated to their final position, the springs 36 keep the rotor locked in place until the plug 14 is once again pushed inward (along axis 21 in FIG. 1A) to compress the springs and unlock the retaining tabs 18, as described below with respect to FIGS. 6A and 6B.

The cover plate 34 also includes a switch tab 37 configured to engage the actuation device 26 and activate the enable switch 25, as described below with respect to FIGS. 4 and 7D. The switch tab 37 extends rearward from the cover plate 34 along an edge margin thereof and also operates as an angle limiter and assists with locking the rotor in place, as described below.

Figure 3:
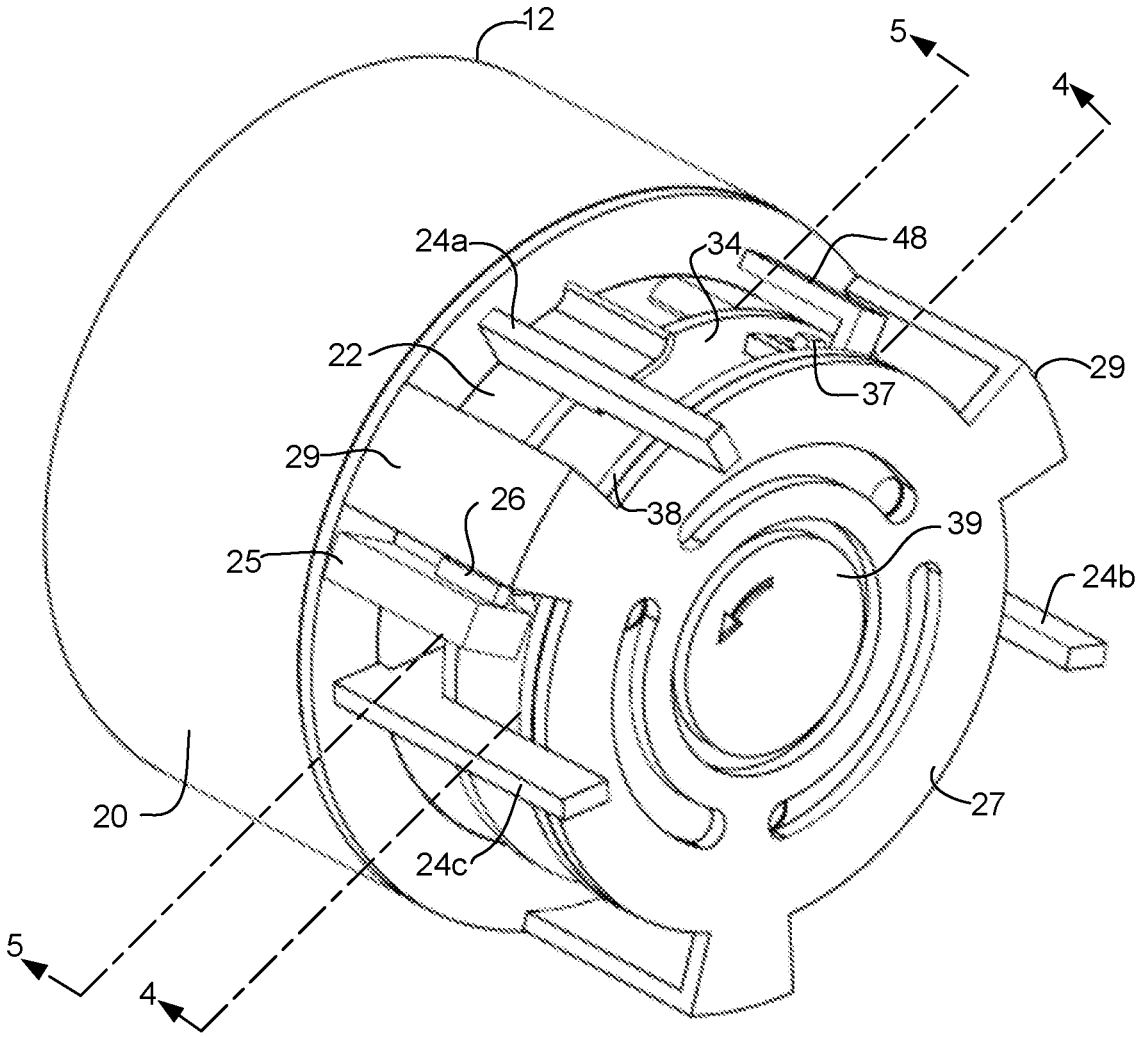
FIG. 3 is an enlarged rear perspective of the receptacle shown in FIG. 1B.

FIG. 3 is an enlarged rear view of the assembled receptacle 12 shown in FIG. 1B. The end cap 27 is mounted on the housing via legs 29, which are inserted into slots 70 on the shell 20 (shown in FIGS. 7B and 7C). The stationary electrical contacts 24*a*, 24*b*, 24*c* and the enable switch 25 are also mounted on the shell 20. In the example shown in FIG. 3, the receptacle is in its OFF position (plug has not yet been rotated). As described below, as the rotor 22 and cover plate 34 are rotated (in the direction indicated by the arrow shown on the cap 39), the switch tab 37 engages the actuation device 26 and activates the enable switch 25, which sends an enable signal to the connected device (e.g., power supply).

Figure 4:
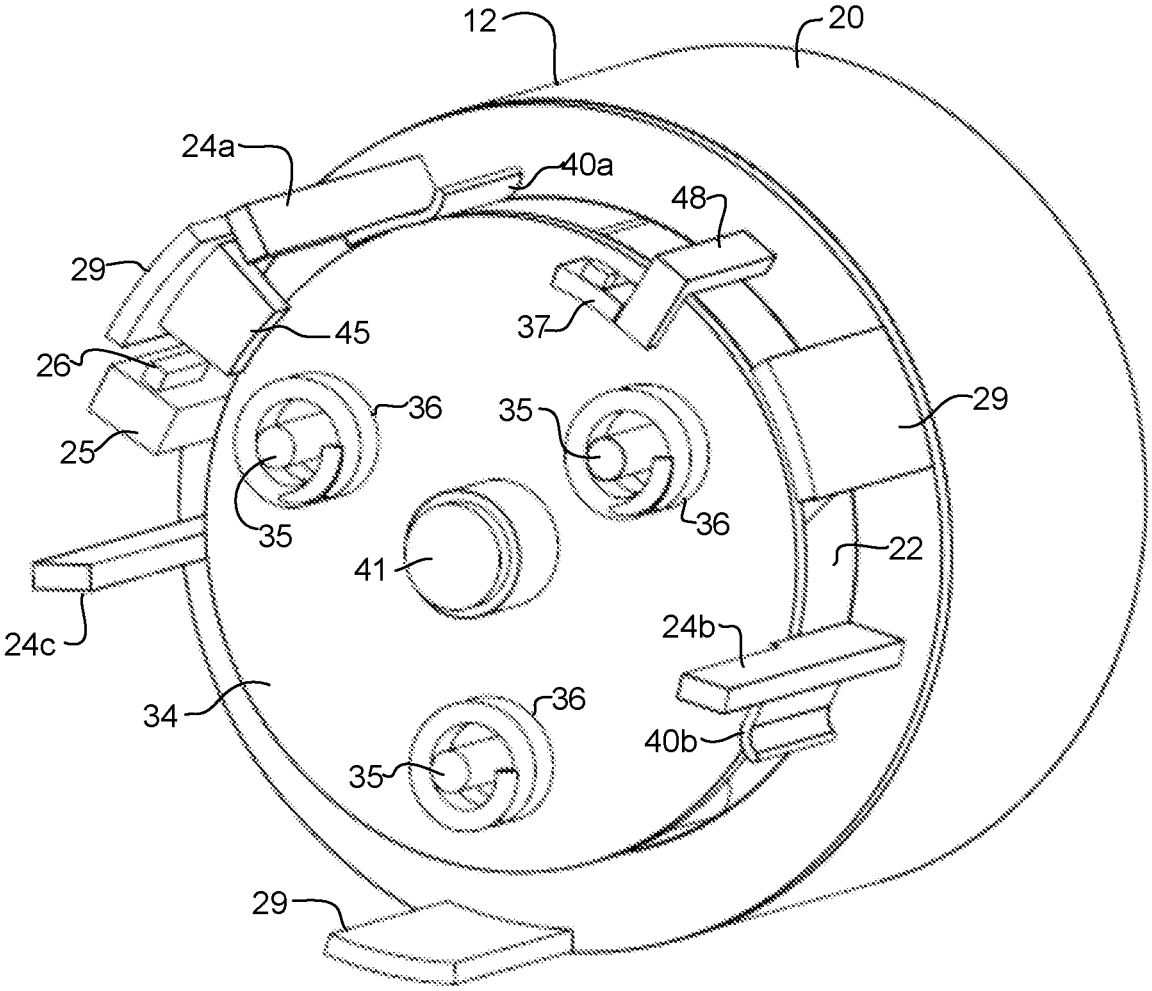
FIG. 4 is a cross-sectional perspective taken along line 4-4 in FIG. 3.

FIG. 4 is a cross-sectional perspective of the receptable 12 taken along line 4-4 in FIG. 3. An L-shaped angle limiter 48 extends from the shell 20 for limiting rotation of the cover plate 34 and attached rotor 22. As shown in FIG. 4, the switch tab 37 contacts the angle limiter, which limits rotation of the rotor and cover plate in the OFF position (no internal electrical connection). The enable switch 25 limits rotation of the rotor 22 and cover plate 34 in an ON position (internal connection made and enable switch activated) when the switch tab 37 contacts the enable switch.

As shown in FIG. 4, one of the legs 29 comprises a lock element 45 extending radially inward from the leg and positioned to limit axial movement of the cover plate 34 through engagement with the switch tab 37. When the plug 14 is inserted into the receptacle and pushed rearward (inward) along the axis 21 (FIG. 1A), the springs 36 are compressed and the switch tab 37 moves counterclockwise (as viewed in FIG. 4) and passes over the lock element 45. When the rotor 22 and cover plate 34 rotate to their final position, the springs 36 are released from their compressed state (due to movement of the retaining tabs 18 on the plug into recesses 19*c* on the inner wall of the shell 20 as described below with respect to FIG. 6B) and the switch tab 37 latches next to the lock element 45 to lock the rotor 22 and cover plate 34 in place.

Figure 5:
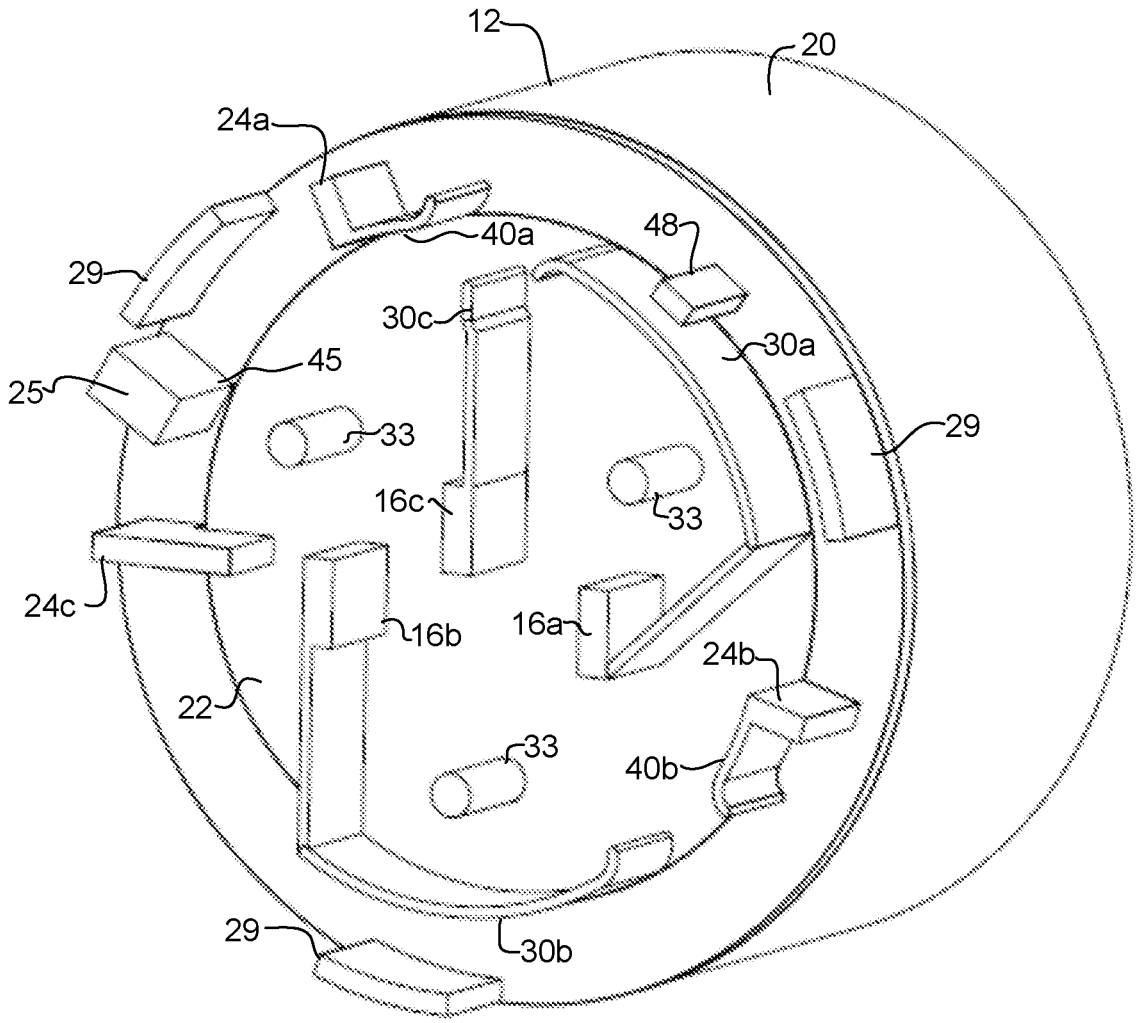
FIG. 5 is a cross-sectional perspective taken along line 5-5 in FIG. 3.

FIG. 5 is a cross-sectional perspective of the receptable 12 taken along line 5-5 in FIG. 3. As shown in FIG. 5, the electrical contacts 24*a* and 24*b* each comprise a brush portion 40*a*, 40*b*. Brush portion 40*a* and the arc shaped brush portion of the internal contact 30*a* define a first brush pair, and brush portion 40*b* and the arc shaped brush portion of the internal contact 30*b* define a second brush pair. Contact arm 30*c* and electrical contact 24*c* define a contact pair. Tips of each brush pair are designed as dedicated sacrificial areas. In one or more embodiments, the tips of each brush pair may be enhanced by manufacturing the leading edge from a metal such as nickel-chromium or stainless steel that has a high electrical resistance. The brush area (wipe portion) is extended to increase a delay between connecting power and activating the enable switch 25. In one or more embodiments, a protective earth conductor is permanently connected between one of the internal contacts and one of the pin contacts. For example, the protective earth conductor may be permanently connected through a full ring and brush pair or via a permanent flexible conductor assembly, which does not comprise a brush pair.

Figure 6A:
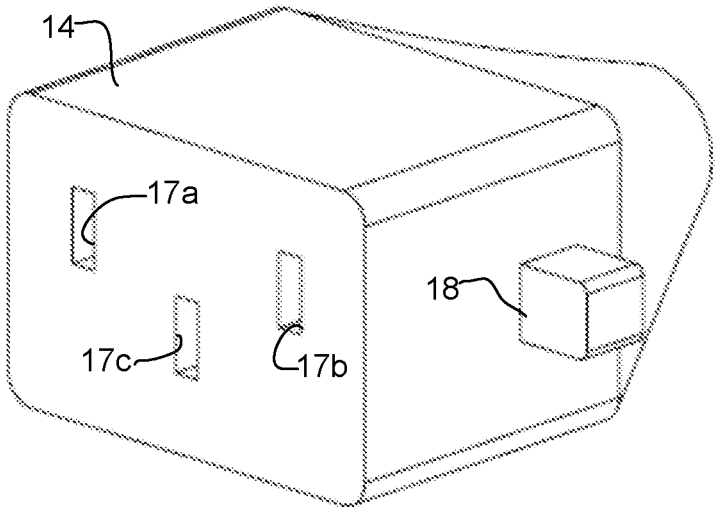
FIG. 6A is rear perspective of the plug of the connector assembly of FIG. 1B.
Figure 6B:
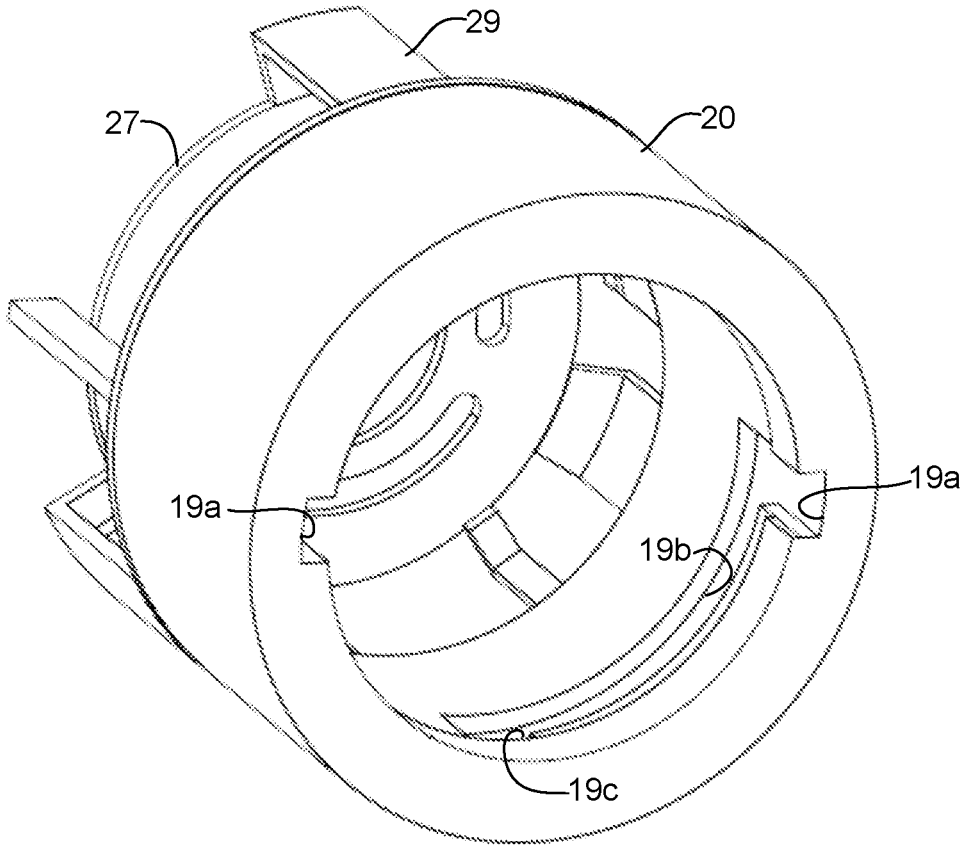
FIG. 6B is a front perspective of a housing of the receptable of FIG. 1A with parts removed to show a locking element for engagement with a locking tab shown on the plug in FIG. 6A, in accordance with one embodiment.

FIGS. 6A and 6B illustrate a plug and receptable locking mechanism, in accordance with one embodiment. FIG. 6A is an enlarged perspective of the plug 14 showing the socket contacts 17*a*, 17*b*, 17*c* and one of the locking tabs 18. The locking tabs 18 may comprise extrusions extending outwardly from sides of the plug. FIG. 6B is an enlarged perspective of the shell 20 and end plate 27, with the rotor and associated components removed to show an internal wall of the shell. In this example, the shell 20 comprises slots 19*a* that permit longitudinal movement of the plug 14 as the locking tabs enter the slots. Once the tabs 18 reach the end of the slots 19*a*, the plug is rotated and the tabs pass circumferentially along the grooves 19*b*, which extend over an arc corresponding to the rotation of the rotor 22 within the shell 20. Once the tab 18 enters the slot 19*b*, the plug 14 is retained in the receptacle to prevent removal of the plug. When the plug 14 has been fully rotated (switch tab 37 contacts switch 25), the tabs 18 are released into recesses 19*c* and the springs 36 lock the plug 14 in place with a final detent (FIGS. 4, 6A, and 6B). In order to remove the plug 14, the plug is pushed inward (rearward) to compress the springs 36, thereby allowing the switch tab 37 to pass the lock element 45 and the retaining tabs 18 to pass back through the grooves 19*b*. The rotor 22 rotates to its OFF position and the plug 14 may be removed with the retaining tabs 18 passing through the slots 19*a*.

The locking feature prevents inadvertent removal of the HVDC plug under load (i.e., before breaking the internal connection). As previously noted, legacy IEC 60320 plugs are able to mate directly with the receptable but have no retention features due the operating voltage being less than 250 VAC, thereby presenting no significant arc hazard. The legacy plug (with no locking tab) can therefore be removed from the receptacle in any position since there is no need to break the internal connection before breaking the external connection.

It is to be understood that the locking mechanism shown in FIGS. 4, 6A, and 6B is only an example and other types of locking systems may be used without departing from the scope of the embodiments. For example, a BNC (Bayonet Neill-Concelman) type connection system may be used. In another example, a fine screw thread on the outside circumference of the plug body that threads into the receptacle shell may provide linear travel and arc containment. A mechanical latch with a release button, a flip-over cable retainer, or any other suitable locking mechanism may be used in place of the locking mechanism described herein.

Figure 7A:
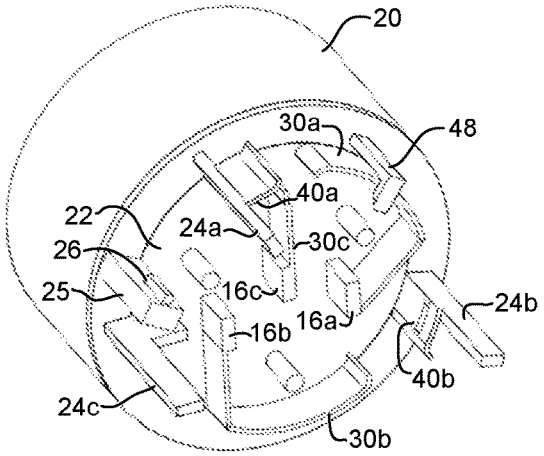
FIG. 7A is a rear perspective of the receptacle of FIG. 4 with a cover plate removed to show internal contacts disengaged from stationary electrical contacts of the receptacle prior to rotation of a rotor within the housing.
Figure 7B:
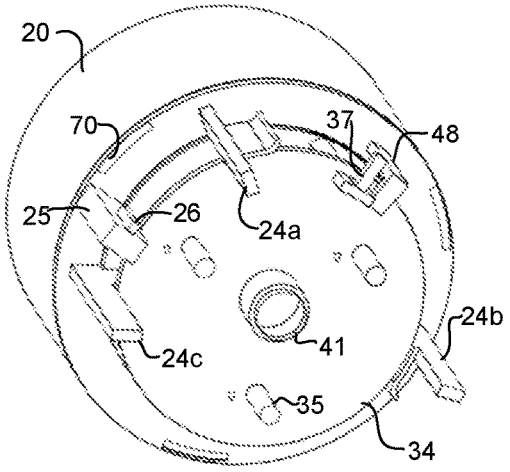
FIG. 7B is a rear perspective of the receptable of FIG. 7A with the cover plate installed.
Figure 7C:
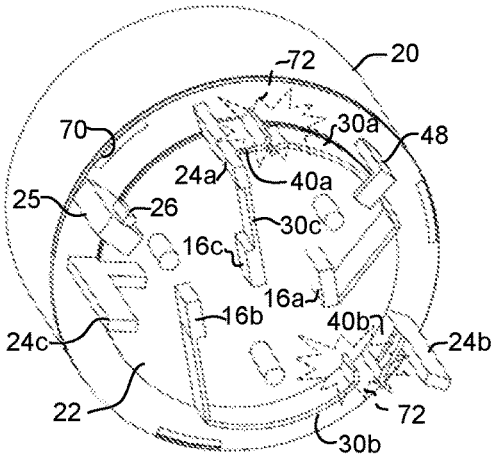
FIG. 7C is a rear perspective of the receptacle of FIG. 7A with the rotor rotated to a position in which an electrical arc may form between the internal contacts and the stationary electrical contacts, with the arc contained within the housing.
Figure 7D:
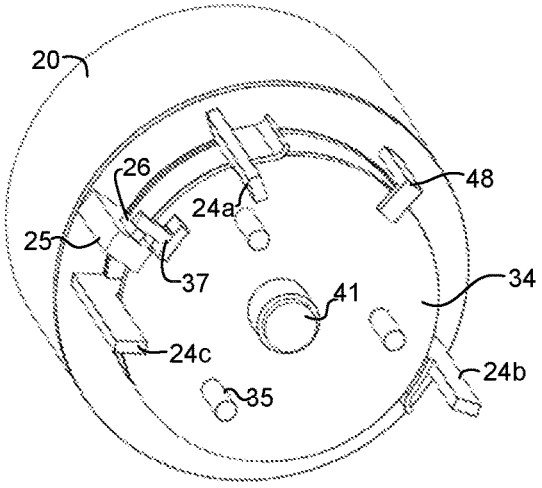
FIG. 7D is a rear perspective of the receptable of FIG. 7B with the rotor rotated to activate an enable switch on the receptacle.

FIGS. 7A-7D illustrate rotation of the rotor 22 and connected components from the receptacle OFF state (internal contacts 30*a*, 30*b*, 30*c* and electrical contacts 24*a*, 24*b*, 24*c* disconnected) to its ON state (internal contacts and electrical contacts connected and enable switch activated), in accordance with one embodiment. Referring first to FIGS. 7A and 7B, the rotor 22 and cover plate 34 are shown in the OFF position. The cover plate 34 is removed in FIG. 7A to show the position of the internal contacts 30*a*, 30*b*, 30*c* relative to the fixed (stationary) electrical contacts 24*a*, 24*b*, and 24*c*. As shown in FIG. 7A, there is no internal connection between the contacts. FIG. 7B shows the switch tab 37 positioned adjacent to the angle limiter 48. The plug 14 may be inserted into the receptacle 12 and the external connection made through engagement of the opposite exposed ends of the pin contacts 16*a*, 16*b*, 16*c* with the socket contacts 17*a*, 17*b*, 17*c* of the plug (FIGS. 1A and 1B).

The plug 14 is rotated after the first (external) connection between the pin contacts on the receptacle 12 and socket contacts on the plug is made. As shown in FIG. 7C, the internal contacts 30*a*, 30*b* approach the corresponding electrical contacts 24*a*, 24*b* as the rotor 22 and connected pin contacts 16*a*, 16*b*, 16*c* are rotated and an electrical arc is formed at locations 72. In one or more embodiments, the electrical arc is reduced through use of the enable switch 25 as power supply enable signal is negated during the rotation.

Further rotation allows the brush portions of the internal contacts 30*a*, 30*b* to wipe over the brush contact area 40*a*, 40*b* of the electrical contacts 24*a*, 24*b* and the arm of the ground internal connector 30*c* contacts the stationary electrical contact 24*c*. The low-voltage enable switch 25 is activated as button 26 is actuated by switch tab 37 (FIG. 7D) and the enable switch asserts an enable signal to the power supply since it is now safe to turn on the power supply. Upon full rotation, the plug is retained in the receptacle with the locking mechanism described above.

It is to be understood that the connector assembly shown in FIGS. 1A-7D and described above is only an example and changes may be made without departing from the scope of the embodiments. For example, any type of movement such as linear or rotational movement along or about any axis may be used to create the internal (second) connection. In one example, the internal connection may be made through rotation about an axis perpendicular to the cable (longitudinal) axis or in a linear sideways direction with a sliding motion. While the examples described herein refer to movement of the plug, it is to be understood that a portion of the rotor (or element coupled to the rotor) may be used to rotate the rotor, which would result in movement of the coupled plug. Thus, movement of the plug as described herein may refer to action initiated through movement the plug or initiated through movement of an element of the receptacle, which results in movement of the plug through the pin and socket connection.

Also, it is to be understood that the connector assembly may be configured without the enable switch or different switch concepts may be used. For example, a switch may control the power supply's internal enable signal or an HVDC contactor external to supply. In place of the switch, a contact pair may be located in the cable assembly. In another example, the two-position enable switch described herein may be replaced with a three-position switch operable to switch between an open circuit, a circuit with current limiting in series, and a circuit with current limiting bypassed.

Figure 8:
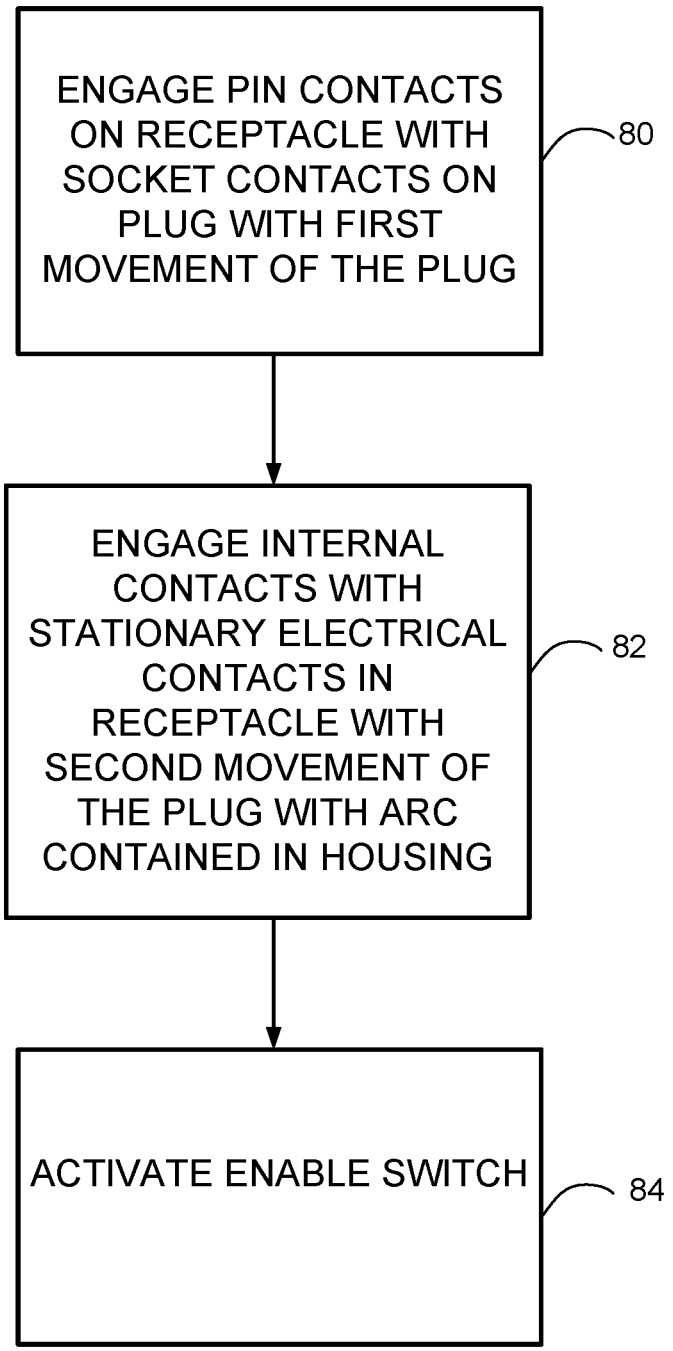
FIG. 8 is a flowchart illustrating an overview of a process for connecting the plug and receptacle with arc containment, in accordance with one embodiment.
Figure 9:
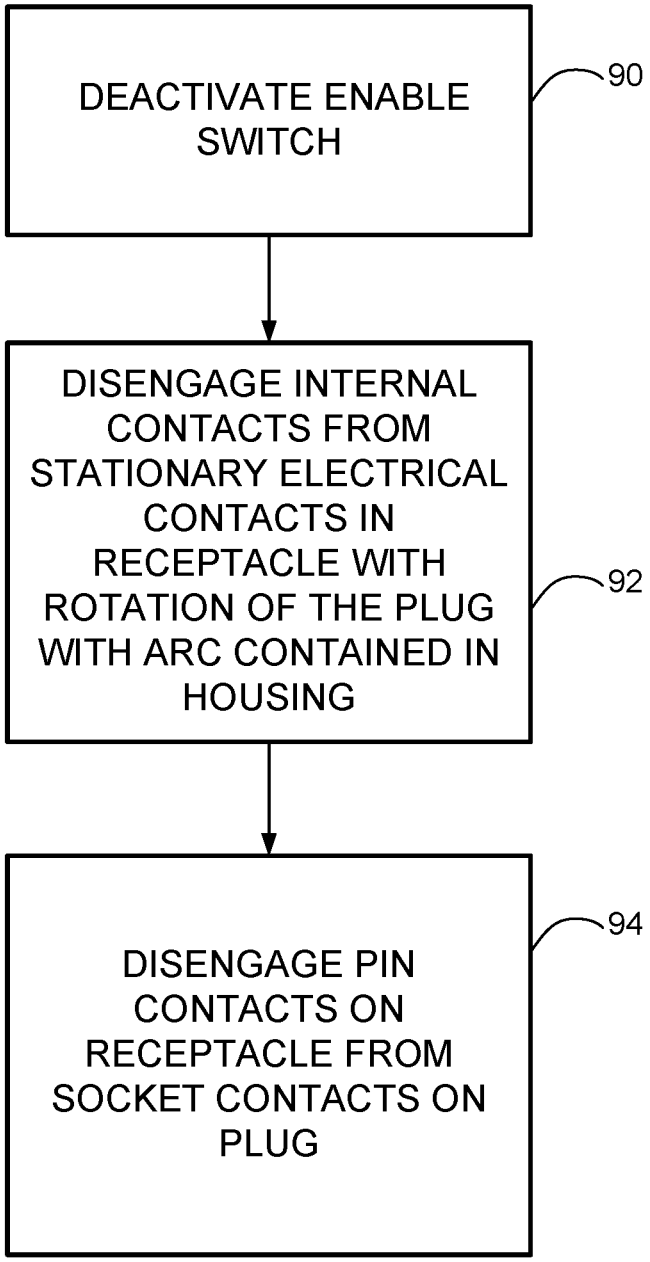
FIG. 9 is a flowchart illustrating an overview of a process for disconnecting the plug and receptacle with arc containment, in accordance with one embodiment.

FIGS. 8 and 9 illustrate an overview of a process for connecting and disconnecting the plug 14 and receptacle 12, in accordance with one embodiment.

In order to connect the plug 14 and the receptacle, the socket contacts 17*a*, 17*b*, 17*c* on the plug 14 are aligned with the pin contacts 16*a*, 16*b*, 16*c* in the receptable 12, as described above with respect to FIGS. 1A and 1B. The pin contacts 16*a*, 16*b*, 16*c* on the receptable are engaged with the socket contacts 17*a*, 17*b*, 17*c* on the plug 14 with a first movement of the plug along the longitudinal axis 21 of the receptacle (step 80) (FIGS. 1A, 1B, and 8). The plug retaining tabs 18 engage with internal groove 19*b* to prevent plug removal while still allowing for the second movement (e.g., rotation). As previously described, the longitudinal axis of the receptacle refers to an axis extending along the pin contacts. The internal contacts 30*a*, 30*b*, 30*c* extending from the pin contacts are engaged with the stationary electrical contacts 24*a*, 24*b*, 24*c* in the receptacle with a second movement of the plug (e.g., rotation about the longitudinal axis) different from the first movement (step 82). As described above, the plug is retained in the receptacle with the start of the second movement as the locking tab 18 enters the slot 19*b* (FIGS. 6A and 6B). An electrical arc between one or more of the internal contacts 30*a*, 30*b* and one or more of the electrical contacts 24*a*, 24*b* is contained within the receptacle housing. As previously described, the process may further comprise, activating an enable switch to transmit an enable signal to the connected device (step 84). As described above with respect to FIGS. 6A and 6B, the tab 18 moves to a final detent position upon full rotation.

FIG. 9 is an overview of a disconnection process for the connector assembly, which is a reverse of the connection process described above. At step 90, the plug is rotated to deactivate the enable switch 25, thereby negating the power supply enable signal and reducing input current to zero. As previously noted, the enable switch is optional. Continued movement (rotation) disengages the internal contacts 30*a*, 30*b*, 30*c* from the stationary electrical contacts 24*a*, 24*b*, 24*c* and breaks the circuit while the plug 14 is still retained within the receptacle 12, therefore any electrical arc is contained within the housing (step 92). The plug retaining tabs 18 engaged with internal groove 19*b* ensure plug removal is only permitted after an internal contact gap is sufficient to fully extinguish any electrical arcing. Once rotation is complete, the tab 18 is released at notch 19*a* (FIGS. 6A and 6B). The pin contacts are disengaged from the socket contacts and the external connection is broken (step 94).

It is to be understood that the processes shown in FIGS. 8 and 9 and described above are only examples and steps may be modified, added, combined, or removed without departing from the scope of the embodiments.

Figure 10:
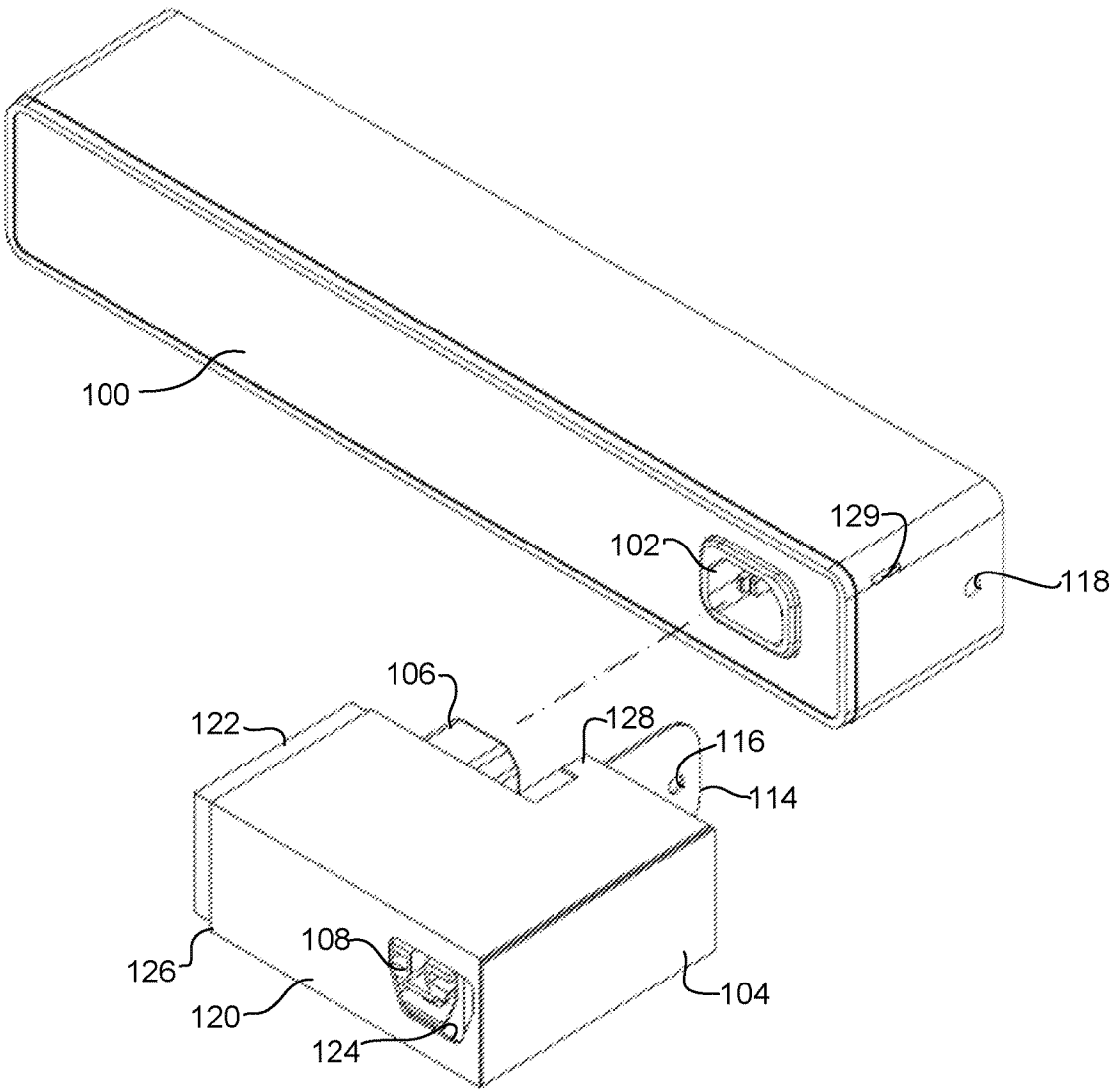
FIG. 10 is a perspective of an adapter for use in coupling an HVDC plug to a standard receptable installed in a device, in accordance with one embodiment.
Figure 11:
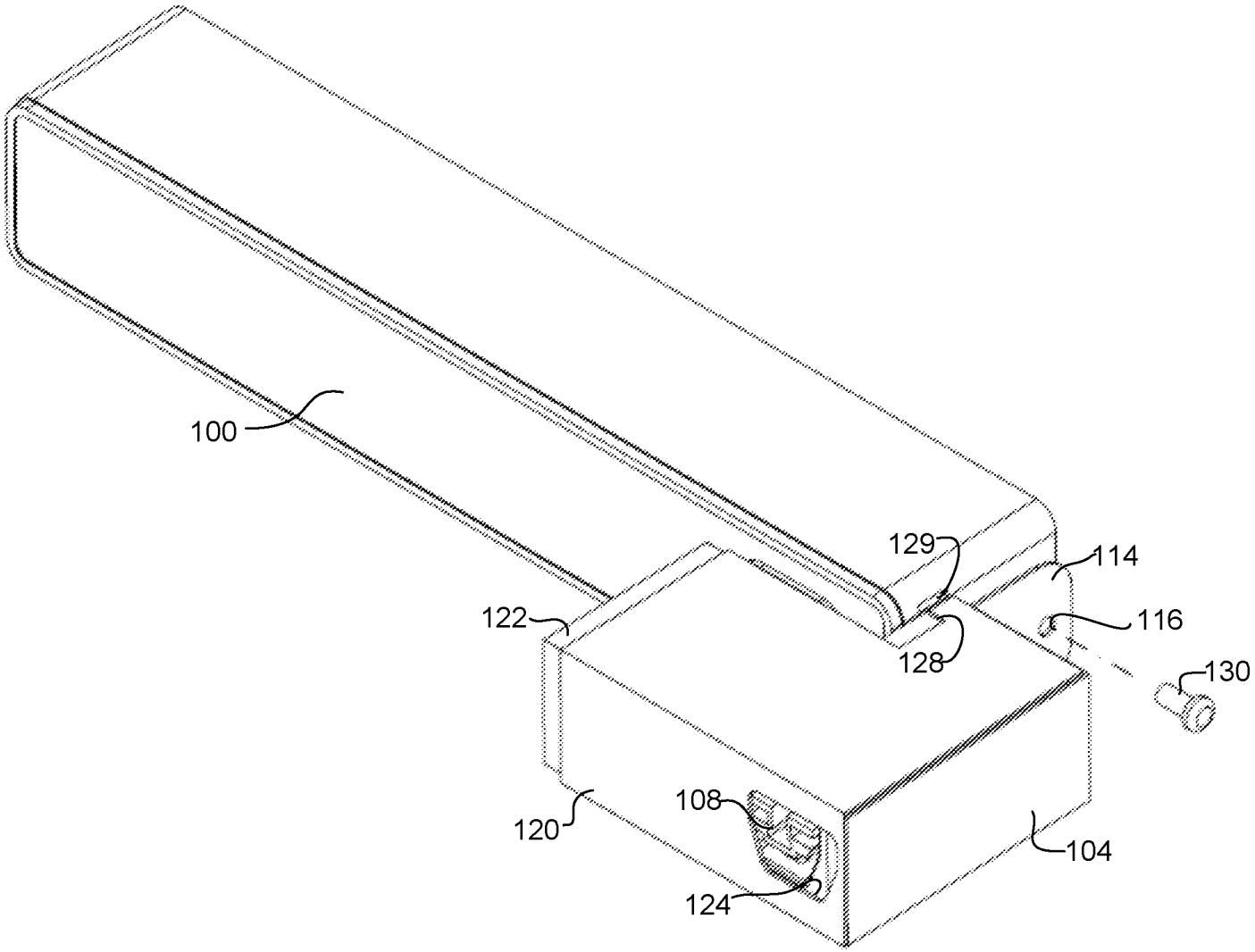
FIG. 11 is a perspective illustrating a standard plug of the adapter connected with the standard receptacle with the adapter in a first position blocking connection to an HVDC receptacle on the adapter.
Figure 12:
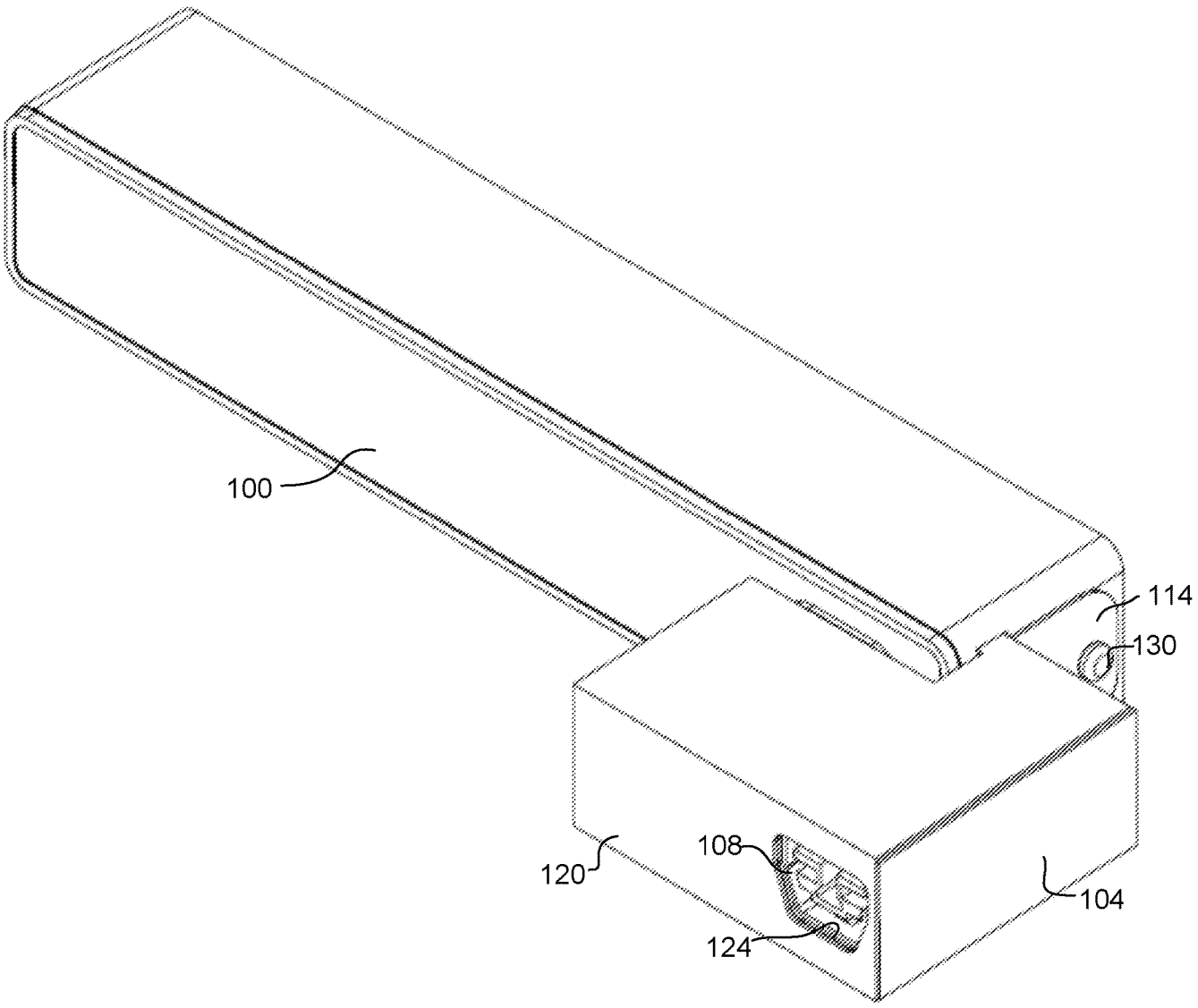
FIG. 12 is a perspective illustrating the adapter connected to the device in a second position allowing for connection of an HVDC plug to the HVDC receptacle.

FIGS. 10-13 illustrate a second embodiment that leverages an HVDC adapter to mitigate HVDC connection and disconnection hazards, while adapting to a standard receptacle (e.g., IEC 60320), which may be permanently installed on an electronic device (e.g., power supply). FIG. 10 shows a portion of a device 100 (HVDC compatible device) having a standard receptacle 102 installed, and an adapter 104 aligned with the receptacle. In one or more embodiments, the adapter 104 comprises a body 122, a standard plug 106 connected to the body and configured for mating with the receptacle 102 on the device 100 to create a connection without electrical arc protection, an HVDC receptacle 108 connected to the body and configured with electrical arc protection, and a housing 120 comprising an opening 124 corresponding to the HVDC receptacle 108. The housing 120 is slidable relative to the body 122 as the adapter 104 moves from a first position (uninstalled position) (FIG. 10) to a second position (installed position) (FIG. 12) when the housing is attached to the device 100. The HVDC receptacle 108 is at least partially blocked by the housing 120 (as shown in FIG. 10) to prevent connection with an HVDC plug when the adapter is in its first position. The opening 124 in the housing 120 is aligned with the HVDC receptable 108 (as shown in FIG. 12) when the adapter 104 is in its second position to allow connection with an HVDC plug 134 (shown in FIG. 13). Simultaneously, the tab 128 on the housing 120 is inserted into the opening 129 on the device 100, which prevents removal of the adapter from the device 100 with the HVDC plug connected to the HVDC receptacle.

It is to be understood that the term "housing" as used herein may refer to a frame, structure, or other element configured for attachment to the device 100 and slidable relative to a body (containing the standard plug 106 and the HVDC receptable 108) to change the adapter from a first state (position) in which the HVDC receptacle 108 is at least partially blocked to a second state (position) in which the HVDC receptacle is accessible for connection to an HVDC plug when the housing is attached to the device and an interlocking feature ensures retention of the housing.

Referring again to the example shown in FIG. 10, the standard plug 106 extends from one side of the housing 120 facing the device 100 and the HVDC receptacle 108 (e.g., Saf-D-Grid® connector) is located on an opposite side of the housing. The HVDC receptacle 108 is electrically coupled to the plug 106 within the adapter body 122 through any suitable means (wires, contacts). The housing 120 comprises a bracket 114 for attaching the adapter 104 to the device 100. In the example shown in FIG. 10, the bracket 114 comprises an opening 116 for alignment with an opening 118 on an edge (edge margin of side wall) of the device 100. A fastener 130 (e.g., screw or other suitable fastener) may be inserted into the aligned openings 114, 118 to secure the housing to the device 100, as shown in FIG. 12.

As shown in FIG. 10, the housing 120 comprises an opening at one end 126 through which the body 122 extends when the adapter is in its uninstalled state (first position). The housing 120 also comprises an opening (not shown) through which the plug 106 extends. The housing 120 may comprise a tab 128 for alignment and insertion into an opening 129 on the device 100 when the adapter is attached to the device to ensure the housing 120 is retained at all times when the HVDC receptacle 108 is accessible.

In the uninstalled state shown in FIGS. 10 and 11, the adapter 104 is in its first position in which access to the HVDC receptacle 108 is blocked by the housing 120, thereby preventing insertion of a mating HVDC plug into the receptacle 108. FIG. 11 illustrates connection of the standard plug 106 and receptacle 102 and alignment of the tab 128 and opening 116 on the housing 120 with openings 129 and 118 on the device 100 (FIGS. 10 and 11). As previously noted, the connection between the standard plug 106 and receptable 102 is an unprotected connection. The adapter 104 is still in its uninstalled state (first position) with the bracket 114 spaced from the device 100 in FIG. 11. Since a power supply cord cannot be attached to the HVDC receptacle 108 due to the position of the housing 120 at least partially blocking the HVDC receptacle, the standard (unprotected) connection between the adapter 104 and the device 100 can only be made in the safe de-energized state (no power at adapter).

After the connection is made between the receptacle 102 and plug 106, the tab 128 on the housing 120 inserts into the opening 129 on the device 100, which prevents disconnection of the receptacle 102 and plug 106, thereby sliding the housing over the body 122, which is held stationary by the connection between the receptacle 102 and plug 106 and engagement of the body against the edge of the device 100 (FIGS. 10-12). The adapter 104 may be further attached to the device 100 by inserting the fastener 130 through the aligned openings 116, 118 and moving the housing to the left (as viewed in FIG. 12). As shown in FIG. 12, sliding motion of the housing 120 relative to the body aligns the opening 124 with the HVDC receptable 108. The HVDC connection (protected connection) can now be safely made between the HVDC receptacle 108 and the HVDC plug 134 and cable 136 shown in FIG. 13. Once the HVDC plug 134 is inserted into the HVDC receptacle 108 through the opening 124, the unprotected connection between the standard receptacle 102 and plug 106 cannot be broken since the housing 120 cannot slide over the body 122 with the HVDC plug 134 installed due to interference between the housing and the HVDC plug at opening 124, thereby maintaining tab 128 in opening 129, which prevents removal of the adapter 104 from the device.

It is to be understood that the adapter 104 shown in FIGS. 10-13 is only an example and changes may be made to the adapter without departing from the scope of the embodiments. For example, the adapter may be connected to the device at a different location with corresponding changes to the sliding motion between the housing and body of the adapter. In one or more embodiments, the tab 128 and opening 129 may comprise a metal rod and a round hole, or any other mechanical interlock. In one or more embodiments, the adapter may also include a standard receptacle electrically coupled to the plug 106 for connecting a standard plug (e.g., <250 VAC plug) to the adapter, thereby providing flexibility as to the type of plug to connect to the adapter based on power supplied. In one or more embodiments, the adapter may include a contact switch (electrical interlock) that disables the power supply (device) 100.

It may also be noted that if a user first attaches the plug 134 to the adapter 104, the adapter would prevent the user from then connecting the energized adapter to the device 100.

Figure 13:
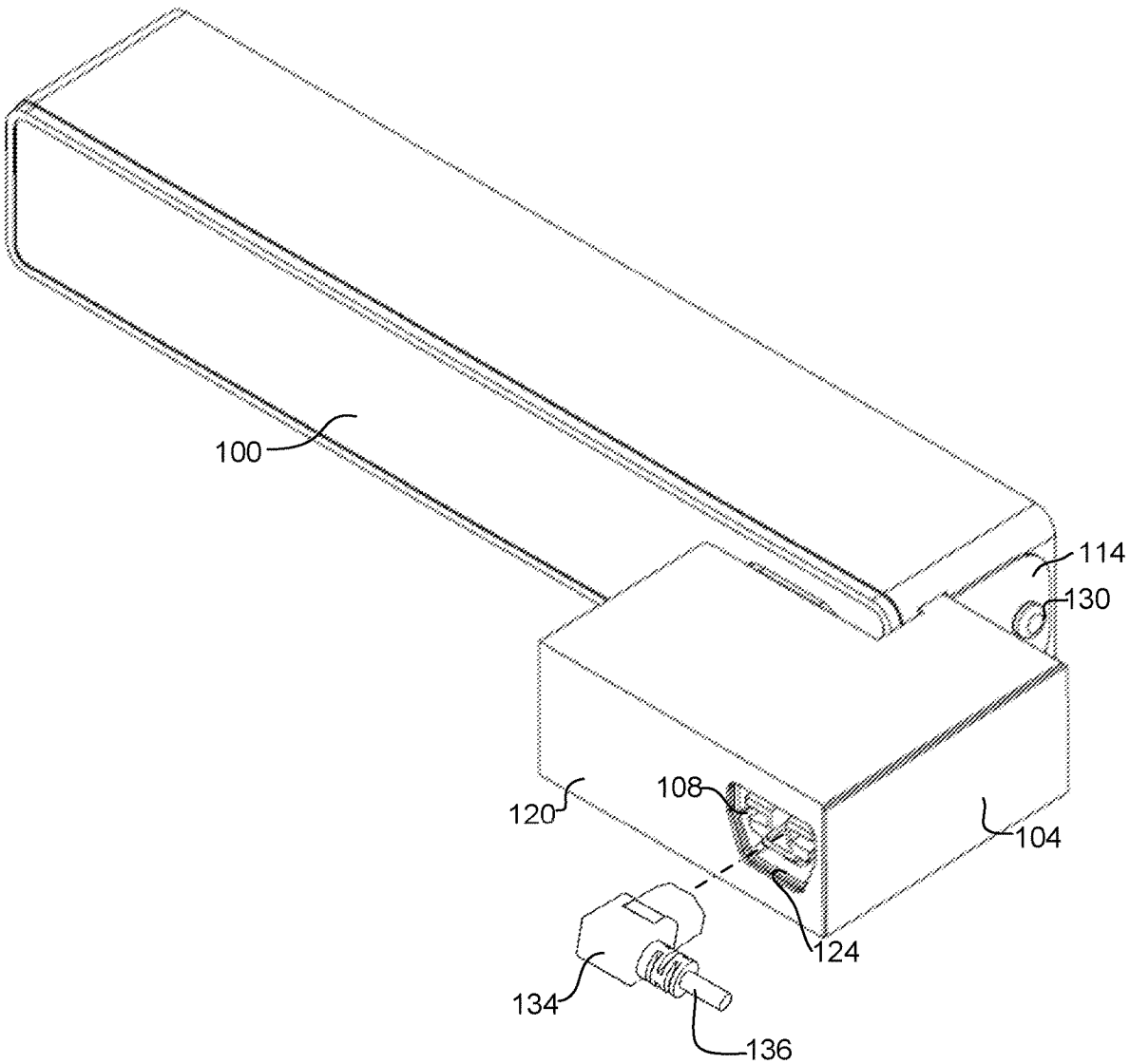
FIG. 13 is a perspective illustrating the adapter connected to the device and an HVDC plug aligned for connection with the HVDC receptacle.
Figure 14:
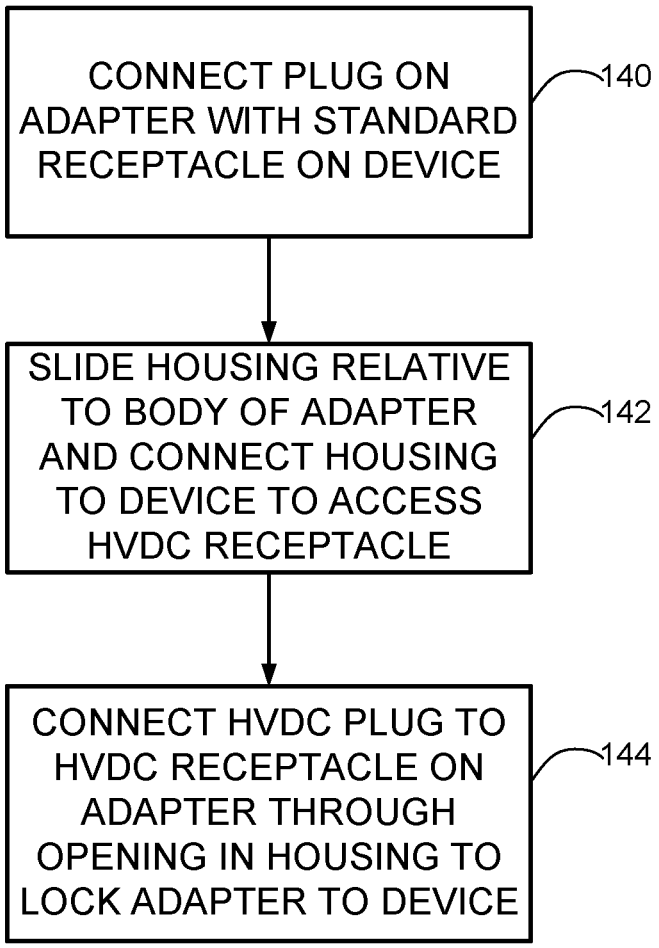
FIG. 14 is a flowchart illustrating an overview of a process for using the adapter to create a safe electrical connection between the standard receptacle and the HVDC plug, in accordance with one embodiment.

FIG. 14 is a flowchart illustrating an overview of a process for using the adapter 104 to provide a protected HVDC connection for a device comprising a standard receptacle that is not suitable for a direct HVDC connection. At step 140, a standard (nonprotected) connection is made by connecting the standard plug 106 on the adapter 104 to the standard receptacle 102 on the device 100 (e.g., power supply) (FIGS. 10, 11 and 14). The housing 120 is slid over the body 122 and the adapter 104 is attached to the device 100 (step 142). Simultaneously, the tab 128 on the housing 120 inserts into the opening 129 on the device 100, which prevents disconnection of the receptacle 102 and plug 106. The opening 124 is aligned with the HVDC receptacle 108 when the housing 120 is attached to the device and the HVDC plug 134 can be connected to the HVDC receptacle through the opening in the housing to lock the adapter to the device (step 144) (FIGS. 13 and 14).

It is to be understood that the process shown in FIG. 14 is only an example and that steps may be added, modified, or combined, without departing from the scope of the embodiments.

Although the method and apparatus have been described in accordance with the embodiments shown, one of ordinary skill in the art will readily recognize that there could be variations made without departing from the scope of the embodiments. Accordingly, it is intended that all matter contained in the above description and shown in the accompanying drawings shall be interpreted as illustrative and not in a limiting sense.

What is claimed is:

1. An electrical receptacle comprising:

a housing;

stationary electrical contacts for transferring power received at the electrical receptacle to a connected device;

pin contacts for mating with socket contacts on a plug to create a first connection when the plug is moved along a longitudinal axis of the housing; and internal contacts extending from the pin contacts and located within the housing for mating with the stationary electrical contacts to create a second connection with movement of the plug different from movement for said first connection;

wherein an electrical arc created between one of the internal contacts and one of the stationary electrical contacts is contained within the housing.

2. The electrical receptacle of claim 1 wherein said movement of the plug to create said second connection comprises a rotation about said longitudinal axis.

3. The electrical receptacle of claim 1 further comprising an enable switch operable to transmit an enable signal to the connected device.

4. The electrical receptacle of claim 3 wherein the enable switch is activated upon movement of the plug.

5. The electrical receptacle of claim 3 wherein the internal contacts are configured to increase a delay between contact with the stationary electrical contacts and activation of the enable switch.

6. The electrical receptacle of claim 1 further comprising a locking element for retaining the plug in the receptacle.

7. The electrical receptacle of claim 6 wherein the locking element comprises a recess formed in an internal wall of the housing for receiving a locking tab on the plug.

8. The electrical receptacle of claim 6 wherein the locking element further comprises a spring.

9. The electrical receptacle of claim 1 wherein the pin contacts extend through a rotor and are rotatable therewith relative to the housing to create said second connection.

10. The electrical receptacle of claim 1 wherein the stationary electrical contacts comprise a brush area for the internal contacts to brush over with said movement of the plug to create said second connection.

11. The electrical receptacle of claim 1 wherein the electrical receptacle is configured for receiving HVDC (High Voltage Direct Current) or AC (Alternating Current) from the plug.

12. The electrical receptacle of claim 1 wherein said movement of the plug to create said second connection comprises translation along a lateral axis.

13. The electrical receptacle of claim 1 wherein a protective earth conductor is permanently connected between one of the internal contacts and one of the pin contacts.

14. A method comprising:

engaging pin contacts on a receptacle with socket contacts on a plug with a first movement of the plug along a longitudinal axis of the receptacle; and engaging internal contacts extending from the pin contacts with stationary electrical contacts in the receptacle with a second movement of the plug different from said first movement;

wherein an electrical arc created between one of the internal contacts and one of the stationary electrical contacts is contained within a housing of the receptacle.

15. The method of claim 14 wherein said second movement comprises rotation about said longitudinal access.

16. The method of claim 14 further comprising activating an enable switch and transmitting an enable signal to a connected device.

17. The method of claim 14 further comprising retaining the plug within the receptacle.

18. The method of claim 14 wherein the receptacle is configured for receiving HVDC (High Voltage Direct Current) or AC (Alternating Current) from the plug and the pin contacts are configured to mate with an IEC 60320 connector.

19. The method of claim 14 wherein said second movement comprises translation along a lateral axis.

20. The method of claim 14 wherein a protective earth conductor is permanently connected between one of the internal contacts and one of the pin contacts.

21. An adapter comprising:

a body;

a plug connected to the body and configured for mating with a receptacle on a device to create a connection without electrical arc protection;

an HVDC (High Voltage Direct Current) receptacle connected to the body and configured with electrical arc protection, the HVDC receptacle electrically coupled to the plug; and a housing comprising an opening corresponding to the HVDC receptacle, wherein the housing is slidable relative to the body as the adapter moves from a first position to a second position when the housing is attached to the device;

wherein the HVDC receptacle is at least partially blocked by the housing to prevent connection with an HVDC plug when the adapter is in said first position, and said opening in the housing is aligned with the HVDC receptacle when the adapter is in said second position to allow connection with the HVDC plug and prevent removal of the adapter from the device with the HVDC plug connected to the HVDC receptacle.

22. The adapter of claim 21 wherein the housing comprises a bracket for attaching the adapter to the device.

23. The adapter of claim 21 wherein the plug extends from one side of the housing and the HVDC receptacle is located on an opposite side of the housing.

24. The adapter of claim 21 wherein the plug is configured in accordance with IEC 60320.

25. The adapter of claim 21 wherein a sliding motion from said first position to said second position interlocks the housing with the device.

* * * * *